United States Patent [19]

Huebner et al.

[11] 4,192,167

[45] Mar. 11, 1980

[54] PROCESS AND APPARATUS FOR UPSETTING PIPE ENDS

[75] Inventors: Bernhard Hüebner, Trier; Dietfried Tresser, Gusterath, both of Fed. Rep. of Germany

[73] Assignee: Laeis-Werke Aktiengesellschaft, Trier, Fed. Rep. of Germany

[21] Appl. No.: 933,920

[22] Filed: Aug. 15, 1978

[30] Foreign Application Priority Data

Mar. 23, 1978 [DE] Fed. Rep. of Germany ..... 2812803

[51] Int. Cl.[2] ..... B21D 22/00

[52] U.S. Cl. ..... 72/356; 72/370

[58] Field of Search ..... 72/356, 359, 370, 377; 76/114

[56] References Cited

U.S. PATENT DOCUMENTS

| | | | |
|---|---|---|---|
| 1,642,696 | 7/1927 | Rateike | 76/114 X |
| 2,748,464 | 6/1956 | Kaul | 72/356 X |
| 3,036,366 | 5/1962 | Ricks | 72/356 X |
| 3,124,876 | 3/1964 | Putetti | 72/356 X |

*Primary Examiner*—Leon Gilden

[57] ABSTRACT

A process and apparatus for upsetting pipe ends, in particular drill rod pipe ends forming tool joints. The pipe end is held in a bottom die of a press and a shoulder mandrel is axially driven into the pipe end by a ram thereby simultaneously upsetting and filling the empty space between the die and the pipe end. The process includes at least two steps. In a first step the pipe end is upset on the outside into a cylindrical pipe section of larger diameter and a defined conical transition region while the internal diameter remains unchanged. In a second step the upset pipe section is swaged inwardly by means of a swaging tool mounted on the ram of the press.

8 Claims, 7 Drawing Figures

PROCESS AND APPARATUS FOR UPSETTING PIPE ENDS

BACKGROUND OF THE INVENTION

This invention relates to a process and apparatus for upsetting pipe ends, in particular the pipe ends of drill rod pipes which form tool joints. The pipe end is held in a bottom die of a press and a shoulder mandrel is actually driven by the ram of the press into the pipe end thereby simultaneously upsetting the pipe end and filling the free space between the bottom die and the pipe end.

Processes and apparatuses of this type are already known. For example in German published application No. 2629796 an hydraulic press of this type is described. In this known hydraulic pipe end-forming machine pipe ends can be upset outwardly or inwardly. However, in swaging the pipe end inwardly difficulties arise, in particular with respect to obtaining a precisely defined transition region between the upset pipe section and the not yet deformed pipe end. Such defined transition regions in pipe ends of the aforedescribed type are, however, essential for drill string pipes with pipe joints, which are standardized with both an inward as well as an outward upset as well as a combination of both.

According to another known process the pipe ends are heated over the length representing a deformation region by different means to a hot forming temperature. The thus heated end is then fed into a mechanical or hydraulic forming machine which is provided with a clamping tool that encloses the pipe end in the forming region. This known device includes an upsetting mandrel the pin of which has a diameter which correspondes to the internal diameter of the pipe end to be upset. The shoulder diameter of the mandrel corresponds to the external diameter of the pipe. This mandrel is driven by means of a hydraulically actuated ram or piston-cylinder unit into the exterior forming-shaping tool. Due to the restricted free space between the shaping tool and the mandrel, the pipe end is upset inwardly so that an internal step is produced in the pipe end. Since the mandrel must be retracted oppositely to the upsetting direction, it is impossible in this case to forge a defined transition region between the original pipe and the upsetted pipe end. In view of the large difference in wall thickness between the undeformed pipe and the upset pipe end there is produced a transition zone which extends over a larger region of the pipe length and the contour of which is ill-defined.

The upsetting process of the state of the art is carried out, independent of the increasing desired wall thickness, in one or several stages. Thus, after a second heating step, the exterior of the pipe end is deformed in additional deforming stations outwardly with suitable tools in a manner analogous to the inward upsetting steps. Since in these known processes the external forming tools act simultaneously as clamping tools, which are constructed as a multi-membered tool, and further in view of the fact that the pipe tolerances for the diameter affect the clamping stroke of the outer die, substantial ridges or fins are produced in this forming process.

SUMMARY OF THE INVENTION

It is the general object of the present invention to provide a process and apparatus of the aforedescribed type which permits a simple and rapid upsetting of pipe ends with a precisely defined transition zone and which require no further working on the circumferential periphery of the formed pipe end.

This object of the invention is obtained by making use of the known principle that an outwardly directed pipe upsetting can be carried out in a defined manner without difficulty by using a unitary outer tool which completely encloses the pipe in the deformation zone and wherein the pipe end is supported in the heated region on the pin of the shoulder mandrel. If then, in a subsequent process step of the invention, the upset pipe end is drawn inwardly by means of a swaging tool, the required internal upset is obtained with a well-defined transition zone.

If one requires to obtain both an inner and an outer upset in the pipe this can be obtained in one of two possible ways. One way would be to provide the swaging tool with a diameter in the cylindrical zone which is greater than the external diameter of the pipe. In this case the pipe upset, formed in the first process step, is only partially drawn inwardly, so that the pipe's pipe upset extends more or less symmetrically inwardly as well as outwardly beyond the restrictive inner and outer pipe diameters. In such a case the internal and external transition zones are precisely oppositely positioned with respect to each other.

If, however, different contours or differently disposed transition zones are required for the internal and external upsets, then the swaging tool can be constructed in such a way that after the swaging step the pipe end assumes again the same diameter it had originally, so that the entire pipe upset is drawn inwardly. In order to achieve the desired outer upset, it suffices, to upset an external pipe section in a further process step equivalent to the first process step.

It should be noted that the process of the invention does not require the tool to be driven to a fixed position at the end of the upsetting process. Rather the pressing stroke is terminated independent with the applied force so that the pipe tolerances have no influence whatsoever on the geometric form of the pipe upsets or transition zones. The pipe tolerances can only affect the length of the free end, which is of no consequence in the present case, since generally a mechanical working of the upset pipe end follows. For example, a friction welding process is made possible. A further advantage of the apparatus of the invention resides in that only the cold portion of the pipe is clampingly held so that the bridging of the pipe diameter tolerances are affected only in the elastic region and thereby no plastic deformation in the form of ridges or fins occur after the clamping process. It is therefore possible to manufacture with the process and apparatus of the invention pipes within the entire range of permissible wall thickness differences without rejection and with defined transition zones. In contradistinction thereto, the known processes only permit the manufacture of very narrow wall thickness tolerances which require the acceptance of a correspondingly high number of rejects.

BRIEF DESCRIPTION OF THE DRAWING

Exemplary embodiments of arrangements in accordance with the invention shown in the attached drawings, wherein.

DETAILED DESCRIPTION

Figure 1:
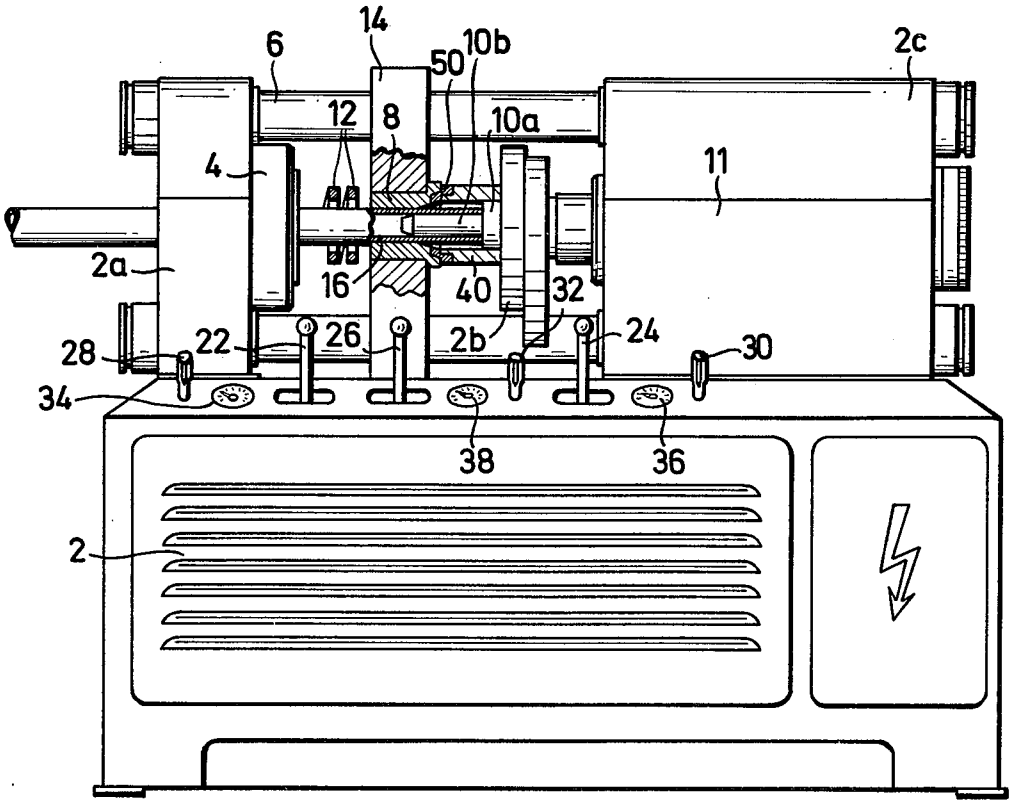
FIG. 1 is a side elevational view, partially in cross section, of the apparatus in accordance with the invention wherein there is included a hydraulic pipe end forming device.
Figure 2:
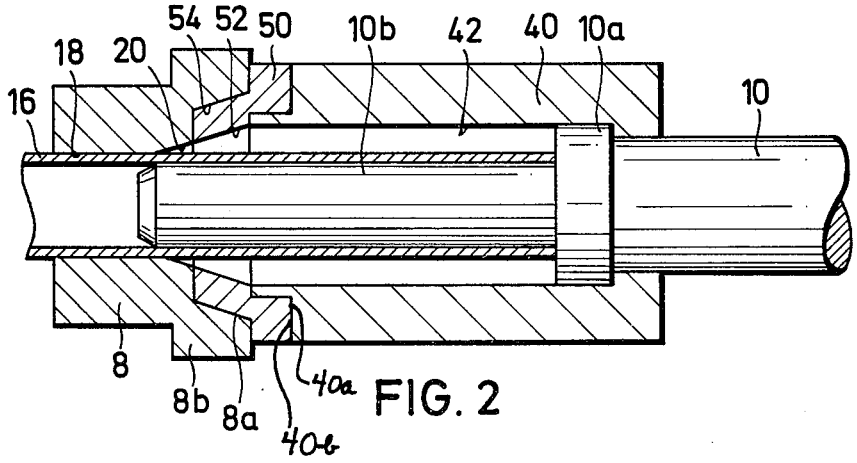
FIG. 2 is a side elevational view, partially in cross section, of the pipe forming tools as positioned prior to the first process step.
Figure 3:
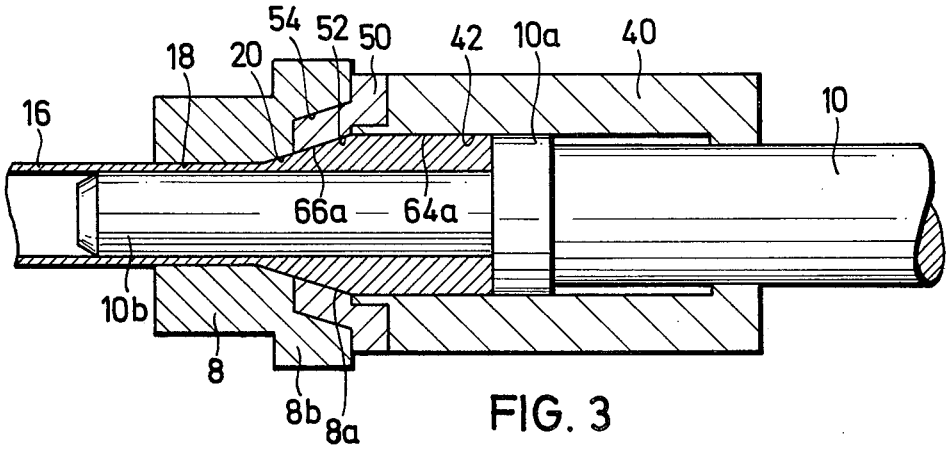
FIG. 3 is a side elevational view, partially in cross section, of the pipe forming tools after the first process step.
Figure 4:
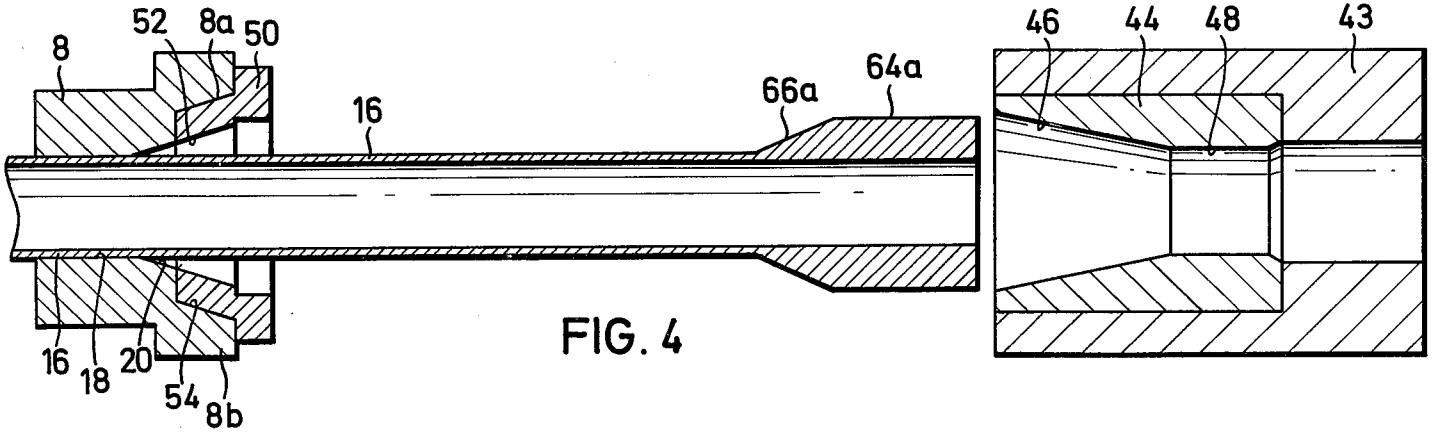
FIG. 4 is a side elevational cross sectional view of the pipe forming tools prior to the second process step.

The pipe end forming machine is used for carrying out the process of the invention can use the equipment and apparatus described and illustrated in the German published patent application No. 26 29 796 coassigned to the assignee of this application. It includes a supporting frame 2 in which the hydraulic units for operating the individual appliances are mounted. A collet chuck 4 is mounted on the base frame or stand 2. This collet chuck 4 is constructed in accordance with the teachings of German published application No. 12 69 934. The collet chuck 4 is displaceably mounted by means of an additional flange disposed on the outer sleeve which is disposed in a cylinder and acts as a ring piston (not illustrated).

A hydraulic piston-cylinder unit 11 is mounted opposite to the collet chuck 4 on the base frame 2. It can be noted the collet chuck 4 and hydraulic piston-cylinder unit 11 are respectively supported on the base frame 2 by means of mountings **2*a*, 2*c*. The mountings 2*a*, 2*c* are joined to each other by means of tie rods 6** which are constructed so as to be capable of absorbing the stresses produced during the forming process.

A tool-forming member **2*b* is mounted on the piston of the hydraulic piston-cylinder unit 11. This tool-forming member 2*b* can be constructed as a capstan head, so that various forming tools, needed for the different steps of the process of the invention, can be mounted in operative position on the hydraulic piston-cylinder unit 11. A clamp strap 14 is fixedly mounted on the tie rod 6 and is adapted to carry a fixed die part 8. The pipe 16, held by a collet chuck 4 is passed through the left opening of the die part 8. A shoulder mandrel 10 having an axially projecting pin 10*b* is mounted on the piston of the piston-cylinder hydraulic unit 11. The shoulder 10*a* of the mandrel 10 is made to bear against the end of the pipe 16. The mandrel 10 is surrounded by a moveable die part 40, which is fitted to the fixed die 8 by means of a removeably mounted die ring 50**.

The pipe end 16 can be heated before being formed by means of a conventional induction coil 12 mounted coaxially around the pipe 16 and being supported on the base frame stand 2 by non-illustrated means. The pipe 16 is first heated by this induction coil 12 before being axially advanced towards the fixed die part 8.

A conventional hydraulic circuit is provided with conventional hydraulic clamping and moving means (not illustrated) to advance the pipe 16 by means of the collet chuck 4. These conventional hydraulic clamping and moving means are controlled by means of a control lever 22 as seen in FIG. 1. The clamping force of the collet chuck 4 can be adjusted to meet the required operative conditions by means of an adjusting knob 28 as seen in FIG. 1. A pressure gage 34 which indicates the prevailing hydraulic pressure in the hydraulic non-illustrated circuit permits a monitoring of the entire operation. The non-illustrated hydraulic circuit includes adjusting means having an adjusting knob 30 as well as a further pressure indicating gage 36. These components serve to control the movement of the mandrel 10. Thus the applied force and speed of displacement of the mandrel are adjustable by means of conventional hydraulic adjusting valve means. Finally an adjusting lever 26 is provided which serves to control the movement of the forming tool. This adjusting means also are controlled by adjusting the driving hydraulic pressure which is done by manually adjusting the knob 32 and the driving hydraulic pressure can be monitored by a gage 38. The aforedescribed hydraulic circuit and adjusting means are described in more detail in applicant's coassigned German published application No. 26 29 796.

FIGS. 2 to 7 illustrate the various forming tools used in the process of the invention and the positions in which these forming tools have been moved during the various process steps of the invention. The forming tools are illustrated at a larger scale than the scale of FIG. 1.

The fixed die part 8 is provided with a flange **8*b* which bears against the clamp strap 14 (see FIG. 1). An axial bore 18 extends to the fixed die part 8 and has the same diameter as the external diameter of the pipe 16 to be worked. This bore 18 expands at the end facing the shoulder mandrel 10 into a conical enlargement 20, which serves as the forming die for the conical transition zone 66*a* of the upset pipe 16 (see FIG. 3). A die ring 50 having an outer conically shaped surface 54 and an inner coaxial conically shaped surface 52 is inserted into a mating conical bore 8*a* disposed in the flange 8*b* of the affixed die part 8. The conical bore 52 of the die ring 50 is aligned with the conical enlargement 20 of the fixed die part 8 and constitutes a continuation of this conical surface. A moveable die part 40 is mounted on the member 2*b* acting on the forming tool and is brought to bear against the removeable die ring 50 via a step surface arrangement 40*a* which bears against a mating surface arrangement 40*b* of the removeable die ring 50. The member 2*b* is axially moved by the hydraulic piston-cylinder unit 11 towards the fixed die part 8. The moving die part 40 has a cylindrical bore 42 the diameter of which is the same as the external diameter of the flange 10*a* of the mandrel 10. The pin 10*b* of the mandrel 10 has an external diameter which is substantially equal to the internal diameter of the pipe 16 and which supports the pipe end of the pipe 16** during upsetting.

The upsetting operation is carried out by bringing to bear the moveable die part 40 against the die ring 50 after the pipe end of the pipe 16 has been heated to a hot forming temperature by being passed through the induction coil 12. The leftward movement of the mandrel 10 thrusts the heated pipe end into the fixed die part 8 and the moveable die ring 50 and moveable die part 40 in the manner illustrated in FIG. 3, whereby the mandrel 10 is moved leftwardly by means of the hydraulic piston-cylinder unit 11 until the pipe end of the pipe 16 is upset and the annular space between the moving die part 40, the die ring 50 and the conical enlargement 20 of the fixed die part 8, on the one hand, and the pin 10*b* of the shoulder mandrel 10, on the other hand, is completely filled by the hot formed metal of the pipe end of the pipe 16. The mandrel 10 is of course moved by the hydraulic piston-cylinder unit 11. In this manner a thickened pipe end portion is formed which has an outer, cylindrical pipe section 64*a* and an outer conically shaped transition zone 66*a*. The external contour of this thickened pipe end section is clearly defined by the shape of the dies 8, 50 and 40, whereby the length of the outer, cylindrical pipe section 64*a* can vary slightly and depends upon the pipe thickness tolerances in view of the fact that the movement of the mandrel 10 ceases when a predetermined pressure has been reached.

After the first process step has been completed, the moving die part 40 is withdrawn, the pipe 16 now having the external upset pipe sections 64*a* and 66*a* is also withdrawn from the fixed die part 8 and the die ring 50, and the member 2*b* for the forming tool is then position so that a moveable swaging tool 44 (see FIG. 4) in the form of a die with a conical bore 46 abutting a cylindrical bore 48 is mounted precisely in front of the pipe section 64*a*, 66*a*. This moveable swaging tool 44 is carried in a die carrier 43, which is fixedly mounted in the member 2*b*. The largest diameter of the conical bore 46 is slightly larger or at least substantially as large as the exterior diameter of the outer cylindrical pipe section 64*a*. The diameter of the cylindrical bore 48 in the illustrated embodiment is substantially equal to the exterior diameter of the pipe 16.

Figure 5:
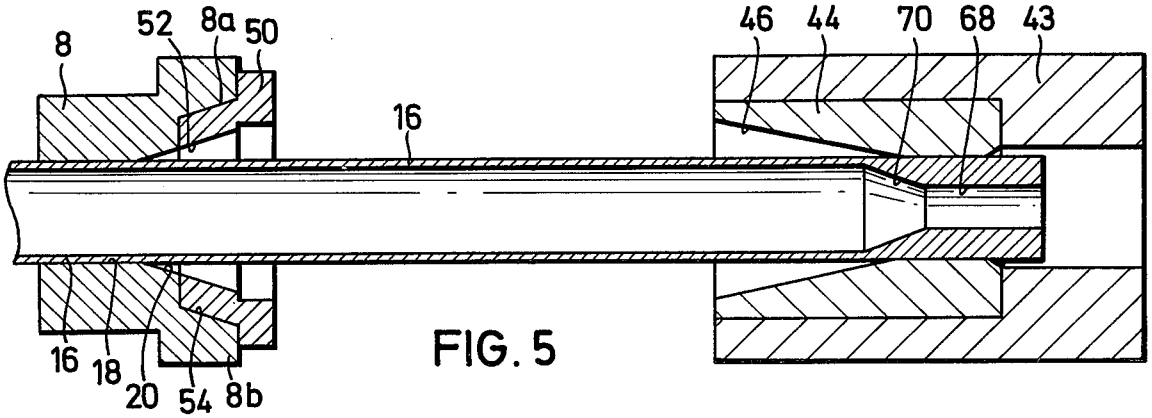
FIG. 5 is a side elevational cross sectional view of the pipe forming tools after the second process step.
Figure 6:
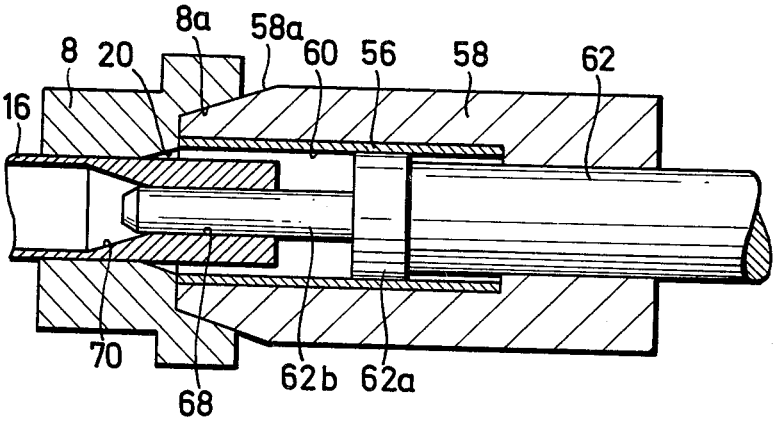
FIG. 6 is a side elevational view, partially in cross section, of the pipe forming tools before the third process step.
Figure 7:
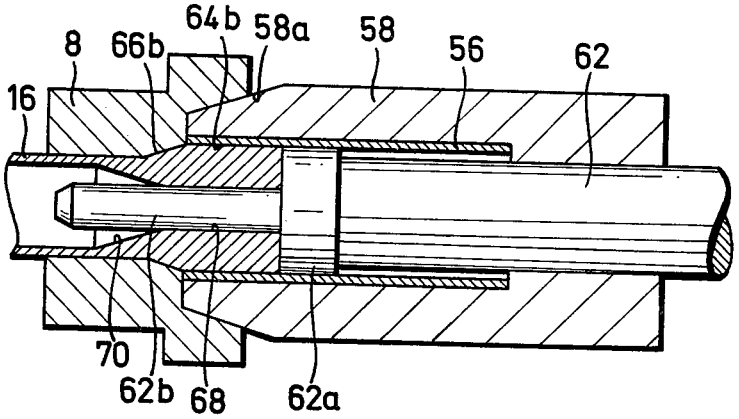
FIG. 7 is a side elevational view, partially in cross section, of the pipe forming tools after the third process step.

In the second process step of the process of the invention the moveable swaging tool 44 is thrust by means of the hydraulic piston-cylinder unit 11 over the cylindrical pipe section 64*a* and the conical transition zone 66*a*. This effects a deformation of the pipe end as illustrated in FIG. 5. Thus an internal cylindrical pipe section 68 with an internal conical transition zone 70 is formed while simultaneously the external diameter of the upset pipe end is again formed so that it is about the same as the external diameter of the pipe 16. Since the swaging of the cylindrical pipe section 64*a* with its conical transition zone 66*a* is effected inwardly, without change of geometric relationships, in particular with respect to the conical transition zone. Thus an internal cylindrical pipe section 68 having an internal conical transition zone 70 is formed, while the external diameter of the upset pipe end is again formed so as to effectively correspond to the required overall dimensions and this forming operation depends exclusively from the shape of the outer, conically shaped transfer zone 66*a* and the outer, cylindrical pipe section 64*a*.

It should be noted that the diameter of the cylindrical bore 48 can also be larger than the external diameter of the pipe 16. In such a case the external upset of the pipe end is not completely drawn in, so that in this manner an upset of the pipe end having internal and external defined dimensions can be achieved by means of two process steps. The length of the external cylindrical pipe section formed in this way corresponds, of course, substantially to the length of the internal cylindrical pipe section and the conical transition zones are disposed relative to each other in a mirror-image relationship. The aforedescribed two process steps are not illustrated in the drawings.

If a different position is required for an external cylindrical pipe section with a corresponding conical transition zone, then for the internal cylindrical pipe section with internal conical transition zone, an additional process step is required. This process step is illustrated by means of FIGS. 6 and 7. After an inner cylindrical pipe section 68 with conical transfer zone 70 has been formed, and the external diameter of the pipe 16 is uniform throughout, including the upset zone, the die ring 50, which may be divided or unitary, is removed and by turning the member 2*b* a moveable die part 56 is brought into the operative position so as to act on the pipe end. The moveable die part 56 is mounted in a die carrier 58 which has an external conical centering region 58*a* adapted to engage with the conical bore 8*a* of the fixed die part 8. The moveable die part 56 has a cylindrical bore 60 the internal diameter of which corresponds to the external diameter of the shoulder 62*a* of another shoulder mandrel 62. Furthermore, the diameter of the cylindrical bore 60 substantially corresponds to the largest diameter of the conical transition zone 20 in the fixed die part 8. A pin 62*b* axially projects from the mandrel 62 and is axially moved into the internal cylindrical pipe section 68 and serves to guide this pipe section 68 during deforming and to define the internal diameter of the eventually formed pipe section. The mandrel 62 is thrust towards the pipe end of the pipe 16 by means of the hydraulic piston-cylinder unit 11 until it reaches the position illustrated in FIG. 7. In this manner an external pipe section 64*b* and an external conical transition zone 66*b* are formed, the geometric forms of which are determined by the fixed die part 8 and the moveable die part 56, and which is different from the geometric form of the internal cylindrical pipe section 68 and the internal conical transition zone 70.

By means of the aforedescribed process steps and the apparatus used therewith it is therefore possible to upset pipe ends in an economical manner which meets the prescribed standards and require no mechanical working with the exception of an adjustment of the length of the formed pipe section.

In dependence of the starting metal material, the upsetting may be carried out cold or the pipe end may be heated to hot forming temperature by the induction coil 12, and such heating step may be repeated between different process steps. It is considered to be of particular advantage that only the region of the pipe end to be formed requires to be heated.

Although the invention is illustrated and described with reference to a preferred plurality of embodiments thereof, it is to be noted that it is in no way limited to the disclosure of such a preferred number of embodiments, but is capable of numerous modifications within the scope of the appended claims.

We claim:

1. A process for upsetting pipe ends, in particular ends of drill pipes forming tool joints comprising the steps of fixedly positioning a pipe end of a drill pipe having a predetermined internal diameter into fixed first die means, said pipe end and first die means defining a free annular space therebetween;

in a first process step axially moving a mandrel toward said pipe end fixedly positioned in said first die means to thereby deform said pipe end by upsetting it and at least partially fill said annular space so that a cylindrical pipe section and a conical transfer zone are formed in said pipe end when positioned by said first die means and said predetermined internal diameter in said pipe and pipe end are maintained; and in a second process step moving said pipe end out of said first die means, fixing said moved out pipe end in position and at least partially inwardly swaging said moved out pipe end by means of a swaging tool.

2. The process for upsetting pipe ends as set forth in claim 1, wherein said inward swaging of said pipe end swages said pipe end to substantially the same external diameter than said drill pipe.

3. The process for upsetting pipe ends as set forth in claim 2, including a third process step in which the pipe end is repositioned in said first die means, reshaping said first die means, and axially moving said mandrel toward said reshaped first die means to thereby further upset the already upset pipe end to a cylindrical pipe end section leaving a defined conical transition zone while maintaining the internal diameter of said pipe and upset pipe end substantially the same.

4. The process for upsetting pipe ends as set forth in claim 3, wherein said pipe end is heated to a hot-forming temperature.

5. The process for upsetting pipe ends as set forth in claim 4, wherein said pipe end is intermittently heated at least after said first and second process steps.

6. The process for upsetting pipe ends as set forth in claim 4, wherein said pipe end is intermittently heated after said first process step.

7. The process for upsetting pipe ends as set forth in claim 4, wherein said pipe end is intermittently heated after said second process step.

8. The process for upsetting pipe ends as set forth in claim 7, wherein said heating is carried out only in said cylindrical pipe section.

* * * * *